United States Patent [19]

Spencer et al.

[11] 4,328,655

[45] May 11, 1982

[54] METHOD OF MANUFACTURING A PACKAGED WEB PRODUCT AND APPARATUS THEREFOR

[75] Inventors: Harvey J. Spencer; William P. Niedermeyer, both of Green Bay, Wis.

[73] Assignee: Paper Converting Machine Company, Green Bay, Wis.

[21] Appl. No.: 122,730

[22] Filed: Feb. 19, 1980

[51] Int. Cl.[3] ..... B65B 11/10; B65B 63/02

[52] U.S. Cl. ..... 53/439; 53/462; 53/450; 53/528; 53/529

[58] Field of Search ..... 53/439, 529, 438, 530, 53/528, 450, 545, 547, 462

[56] References Cited

U.S. PATENT DOCUMENTS

| | | | |
|---|---|---|---|
| 2,567,201 | 9/1951 | Goepfert | 53/520 X |
| 3,020,687 | 2/1962 | Joa | 53/529 X |
| 3,044,228 | 7/1962 | Peterson | 53/439 X |
| 3,513,628 | 5/1970 | Lee et al. | 53/530 |
| 3,532,516 | 10/1970 | Erekson | 53/450 |
| 3,655,478 | 4/1972 | Geschwender | 53/450 X |
| 3,710,536 | 1/1973 | Lee et al. | 53/530 X |
| 3,729,886 | 5/1973 | Lucas et al. | 53/439 X |
| 3,848,398 | 11/1974 | Suhr | 53/530 |
| 4,041,813 | 8/1977 | Spencer | 83/329 X |
| 4,110,954 | 9/1978 | Olsson et al. | 53/529 X |

FOREIGN PATENT DOCUMENTS

| | | | |
|---|---|---|---|
| 1023990 | 3/1966 | United Kingdom | 53/529 |

*Primary Examiner*—Robert D. Baldwin
*Assistant Examiner*—J. Reed Batten, Jr.
*Attorney, Agent, or Firm*—Tilton, Fallon, Lungmus & Chestnut

[57] ABSTRACT

A method of manufacturing a packaged web product and apparatus therefor wherein superposed webs are compressed and while compressed webs pass through an open-ended forming device having a closed perimeter and simultaneously enveloping the compressed, superposed webs, and thereafter transversely severing the resultant product into identical units.

27 Claims, 16 Drawing Figures

FIG. 7
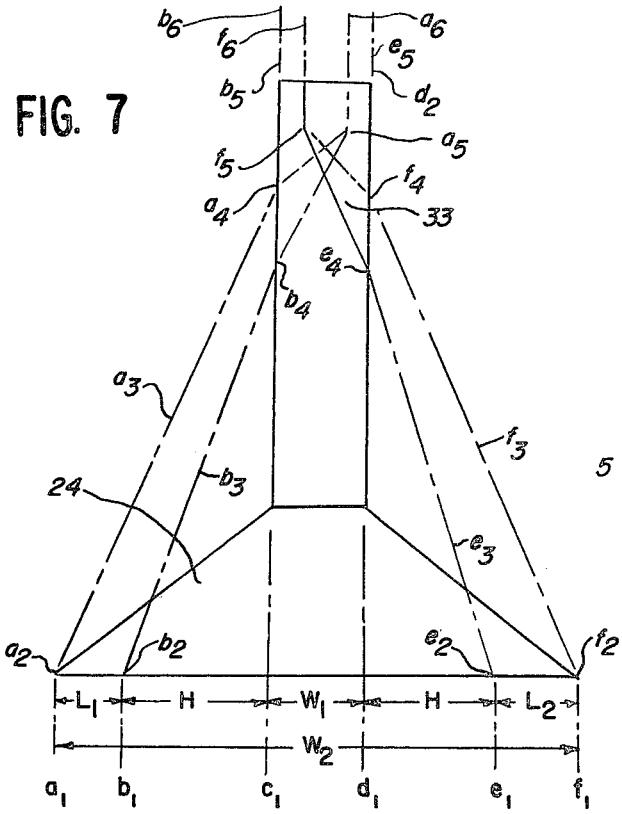
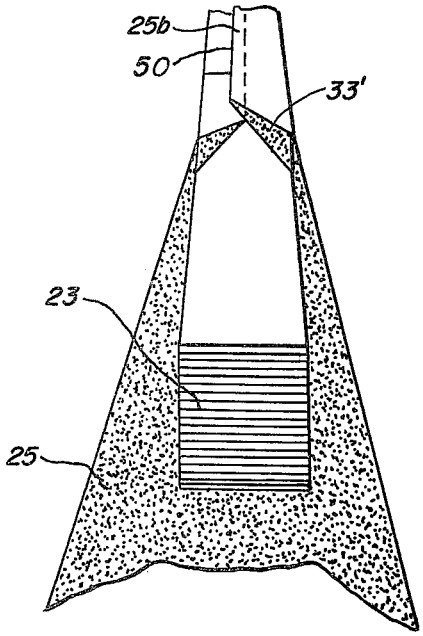
FIG. 8
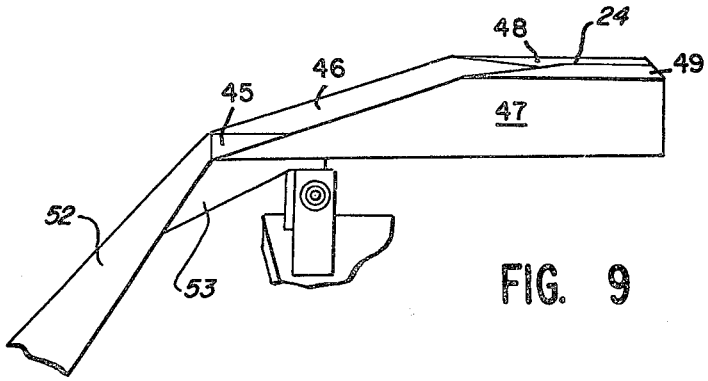
FIG. 9
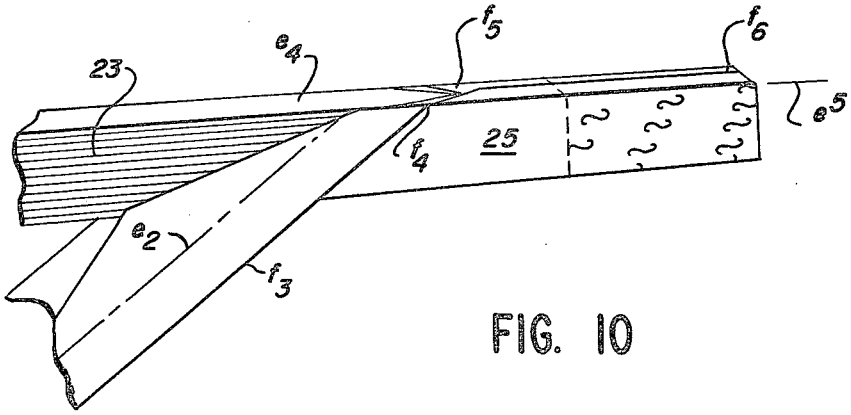
FIG. 10

METHOD OF MANUFACTURING A PACKAGED WEB PRODUCT AND APPARATUS THEREFOR

BACKGROUND AND SUMMARY OF INVENTION

This invention relates to a method of manufacturing a packaged web product and apparatus therefor and, more particularly, to a method and apparatus for continually producing superposed web products such as toweling.

Paper towels, facial tissue and like products whether interfolded, C-folded or V-folded, have been produced for years by developing individual stacks and thereafter banding the same for transportation to the ultimate customer or site. These are often mounted in a wall dispenser in public washrooms and the like and may number several hundred web units arranged in a stack usually at least 6" high.

In an effort to provide a more efficient process for manufacturing these packaged web products, a continuous enveloping operation was considered. The idea of utilizing a continuous enveloping operation—as by passing the product to be wrapped through a shoe and continuously folding around it an indefinite length web, has been well known for a great variety of products. Insofar as superposed web products are concerned, it has been employed for cigarette papers as seen in U.S. Pat. No. 2,567,201. However, the teachings of the prior art relative to enveloping were unsatisfactory when it came to packaging superposed web units of substantial size and extent—as with paper towels of substantial compressability—especially continuous webs being processed at high speeds. In addition, the inventive apparatus discloses, for the first time, a means to adopt high speed packaging of continuous webs so that an extended range of basis weight and caliper wrapping materials can be used, including chipboard with basis weights greater than 50 pounds per ream, or even thicker wraps like corrugated material.

The drawbacks of the prior art were solved by the instant invention which employs a critical step of compressing the superposed webs in a direction perpendicular of the super position thereof to an extent of reducing the superposed height to below about 75% of the uncompressed height and thereafter passing these compressed webs through an open ended forming device having a closed perimeter shaped to the dimensions of the compressed superposed webs and thereafter simultaneously enveloping the wrapping material about these webs. The enveloping web is of indefinite length and is longitudinally sealed after which the now packaged "sausage" is transversely severed while the enveloped webs are being advanced at a uniform rate. The practice of the invention has resulted in packages which are characterized by clean-cut, square ends, equaling, if not surpassing the previously banded packages and at substantial savings in time, personnel and equipment.

DETAILED DESCRIPTION

The invention is described in conjunction with the accompanying drawing in which FIG. 1 is a fragmentary side elevational view of apparatus for practicing the instant invention;

FIG. 7 is a top plan view of the web former employed to envelope the superposed compressed webs and shows wrapper web travel lines in phantom;

FIG. 8 is a top perspective view of the wrapping material former sighted from the infeed end, with a typical superposed C-folded web stack being seen in the process of being enveloped by an outer web; with the inside of the outer wrapper web shown shaded for clarity;

FIG. 9 is a view similar to FIG. 7 but being a different perspective view taken essentially from the side of the wrapper forming apparatus;

FIG. 10 is a view similar to FIG. 9 but showing the web product in the process of being enveloped;

Figure 2:
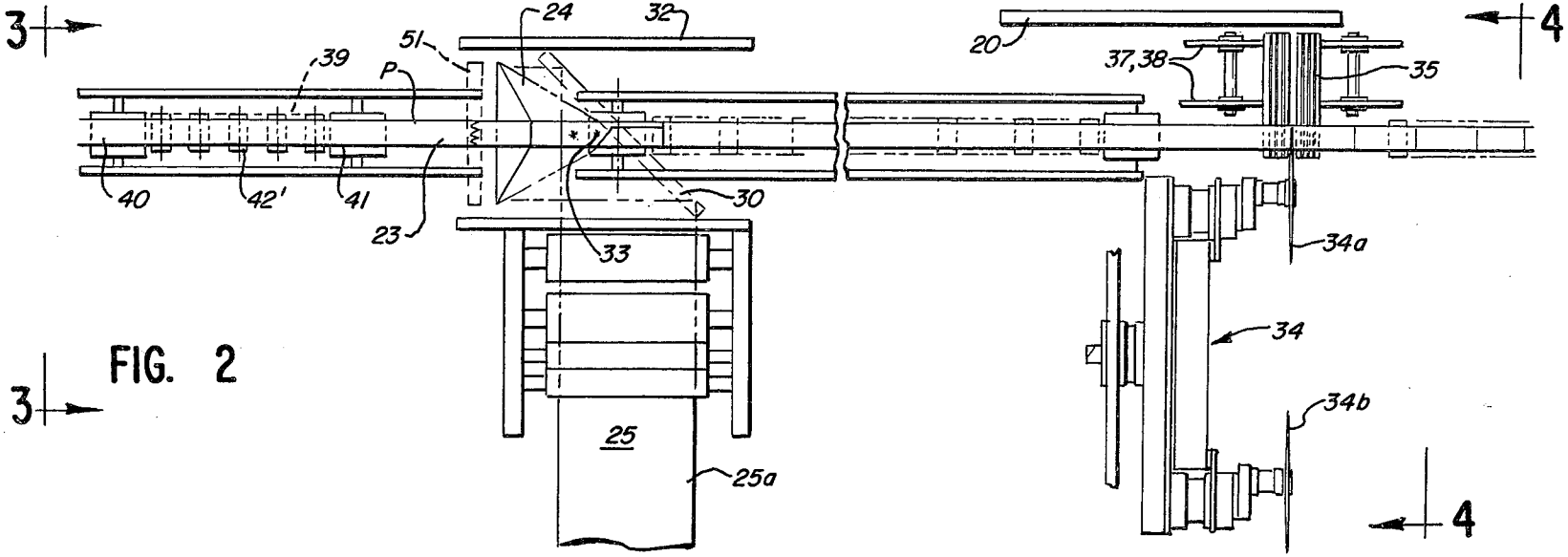
FIG. 2 is a top plan view of the apparatus of FIG. 1.
Figure 1:
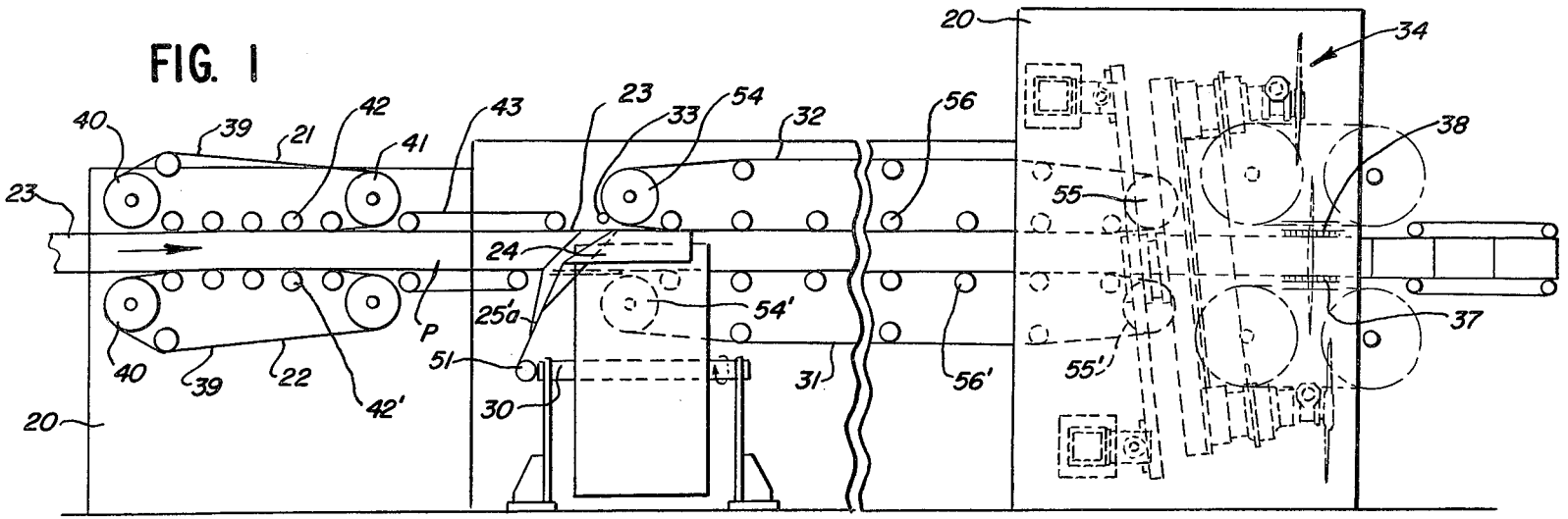

Referring to the first drawing sheet, the numeral 20 designates generally in both FIGS. 1 and 2 framework of the apparatus. Starting at the left hand end, the frame supports upper and lower compression belts 21 and 22 respectively. These belts serve to compress a continuous stack of superposed web units 23 (see FIGS. 3 and 4). More particularly, the compression belts 21 and 22 serve to compress the height of the superposed units at least about 75% of its uncompressed height. The superposed web units may be derived from a series of unwind stands and brought into a single lineal path through suitable turning bars 143 as will be brought out hereinafter relative to the embodiment seen in FIG. 11.

As the superposed continuous webs proceed to the right in FIG. 2 (and while under compression), they encounter an open-ended forming device 24 in the path P which can be seen in greater detail in FIGS. 7 and 9. Forming device 24 is shown solid for the purpose of clarity, despite the fact that wrapper web 25 overlays same, and web 25 is shown in phantom (see also FIG. 7). The open ends of device 24 are shaped to the dimensions of the compressed stack and has a closed perimeter as can be appreciated from a consideration of FIG. 7. More particularly, the former contacts all four sides of the stack of superposed webs to maintain the compressed dimensions.

Figure 3:
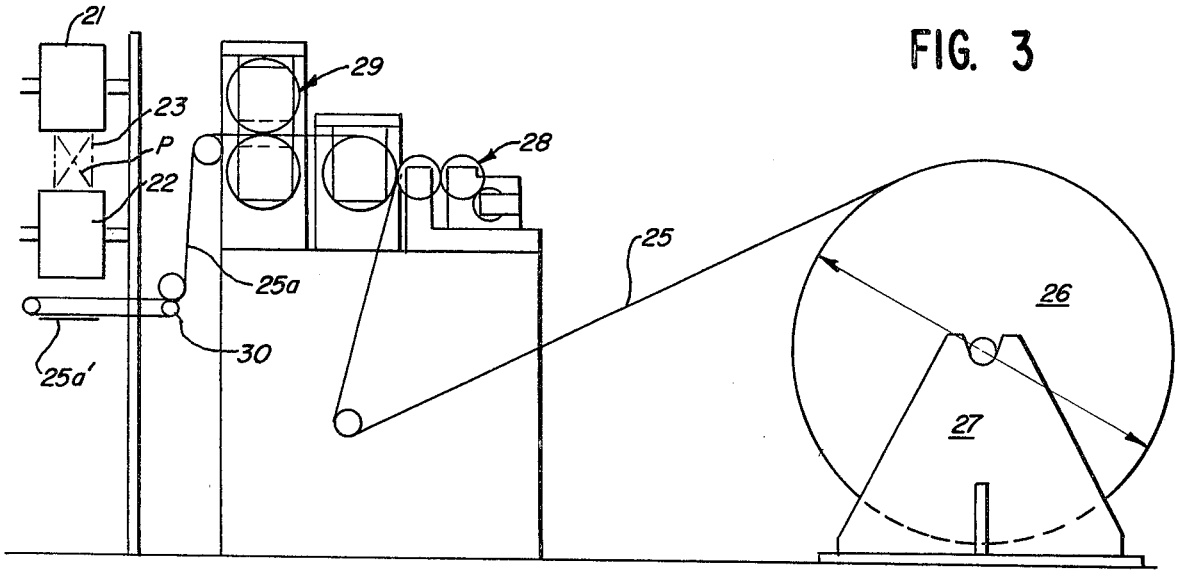
FIG. 3 is an end elevational view as would be seen along the sight line 3—3 of FIG. 2.
Figure 5:
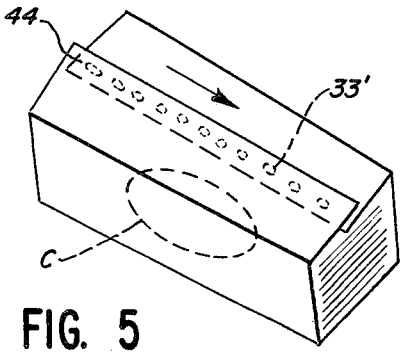
FIGS. 5 and 6 are perspective views of packages produced according to the practice of the invention.
Figure 6:
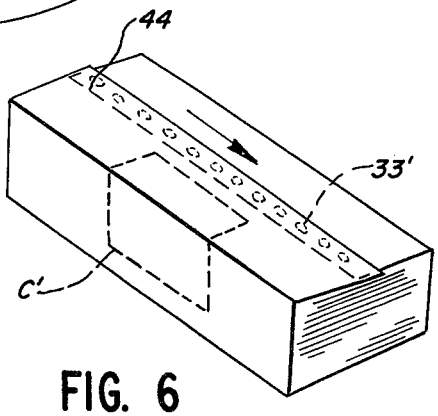

As indefinite length web 25 is brought into the path P for enveloping the compressed superposed webs and may be advantageously pre-processed in the manner indicated in FIG. 3. The wrapper or enveloping web 25 is derived from a parent roll 26 mounted on a suitable unwind stand 27. The web 25 passes through a printing device generally designated 28 and a perforator generally designated 29—before entering the path P in which the superposed, compressed web units 23 are being advanced. Printed side 25*a* enters on the top turning bar 30 and exits with printed side 25*a*′ on the bottom before flowing across former 24 and entering path P—wherein printing will subsequently be on the outside of the finished wrapped package. The role of the perforator is to provide equally longitudinally spaced apart patterns of perforations as at C and C′ in the package representations of FIGS. 5 and 6, respectively.

After envelopment by the web 25, the superposed stacks proceed further to the right in FIG. 1 and after exiting from folder 24 are still held under compression by virtue of compression belts 31 and 32. It will be appreciated that the various compression belts are entrained on various rollers which in turn are suitably journalled in the frame 20. The compression continued by the belts 31 and 32 insures that the overlapped, longitudinally extending portions of the web 25 are suitably united—the sealing being indicated schematically as at 33 in the central portion of FIGS. 1 and 2.

After the sealing has been effected, the continuous (now packaged) webs pass into a severing zone where a continuous motion saw generally designated 34 cuts the "sausage" transversely. It will be appreciated that the saw 34 moves with the product—this being apparent from a consideration of FIG. 1 where the saw in cutting moves from an upper left hand position to a lower right hand position. This type of orbital saw which is also depicted schematically in FIG. 4 can be seen in U.S. Pat. No. 4,041,813.

Figure 4:
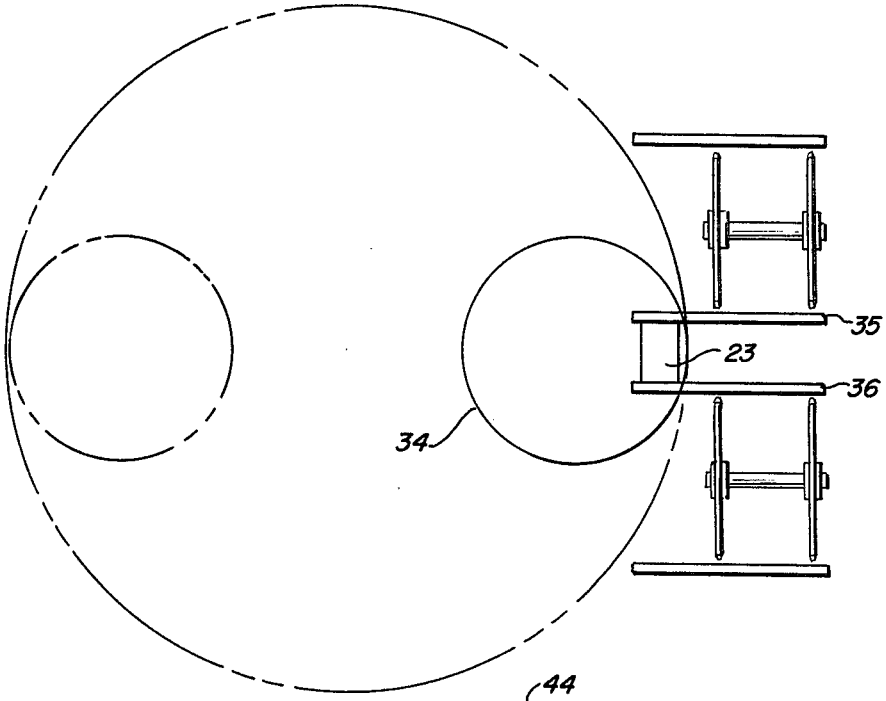
FIG. 4 is end elevational view seen along the line 4—4 of FIG. 2.

Referring now to FIG. 4, the superposed product 23 is seen to be confined (at the time of cutting) between upper and lower bars 35 and 36 which are carried by offset chains 37 and 38 (see FIG. 1) and are entrained over suitable head and tail sprockets.

STRUCTURAL DETAILS OF APPARATUS

Referring again to the left hand portions of FIGS. 1 and 2, it will be seen that the conveyors 21 and 22 include belts as at 39 which are wider than the superposed webs 23 (see particularly FIG. 2). The belts 39 are entrained over head and tail rolls 40 and 41, respectively and thereafter a number of intermediate smaller idler rolls as at 42, 42′. This insures that the entire width of the stacked webs will be uniformly compressed and the entering or head rolls 40 are spaced apart a distance somewhat greater than the intermediate rolls 42, 42′ so as to minimize the shock of compression.

In the illustration given, a further set of conveyor belts as at 43 (see the central part of FIG. 1) maintain the compression between the belts 39 and the former 24. The superposed webs 23 then enter the former 24 which, in the illustration given, is constructed so as to provide the overlap of the enveloping web 25 along the top of the superposed web sausage 23. Both the constructions of FIGS. 5 and 6 reflect this—but it will be appreciated that the former 24 can be oriented differently so as to provide side or bottom seals—as contrasted to the top seal 44 illustrated. It will be appreciated that spaced adhesive dots 33′ (shown phantom) can also be applied as a continuous line of adhesive.

The former as can be best seen in FIG. 9 includes an elongated sheet metal body of sufficient rigidity to withstand the tendency of the compressed webs to return to the uncompressed state. The body includes a bottom wall 45 and upstanding sidewalls 46 and 47 which merge into wings 48 and 49 respectively. The wings overlap in the zone 50 (see FIG. 8)—being spaced apart just sufficient to permit the passage therethrough of the right hand longitudinal edge portion 25*b* of the wrapper 25.

The wrapper 25 after passing over the turning bar 30 moves rearwardly and over an idler roll 51 and up over the flared inlet plate 52 (see FIG. 9 and compare FIG. 10) of the former 24. The flared inlet plate 52 may be suitably connected in rigid fashion to the remainder of the former 24 by means of a gusset 53 (see FIG. 9).

After the sealing has been achieved via the applicator 33, the now-enveloped but still compressed web stack 23 immediately encounters the compression belts 31 and 32 which, like the belts 21 and 22 include head and tail rolls 54, 54′ and 55, 55′ and a plurality of intermediate rolls 56, 56′. Again, the intermediate rolls 56, 56′ are spaced closer together (vertically) than the head and tail rolls. The belt systems 31 and 32 are of considerably greater length than the belt system 21 and 22 so as to insure adhesive set-up time for a strong bonded union between the overlapped longitudinal edge portions 25*b* (see FIG. 8).

As the stacked webs proceed further to the right in FIGS. 1 and 2 (and beyond the tail rolls 55, 55′), the enveloped sausage 23 is now taken over by the bars 35 and 36 which are carried by the offset chains 37 and 38. As can be appreciated from a consideration of FIG. 2, the bars 35 and 36 are longitudinally spaced apart at predetermined intervals to permit the passage therebetween of the rotating disks 34*a* and 34*b* of the saw 34.

FIG. 7 is a top plan view of former assembly 24 shown in solid lines. In operation, a web of wrapping material 25 covers plate 24 when viewed from the top, but for sake of illustration, the web path is shown by a series of lines $a_1$, $a_2$ . . . $f_1$, $f_2$, etc.

In FIG. 7, $W_2$ represents the total web width, $W_1$ is the package width, H represents package height, $L_1$ is the underlying marginal edge portion of the web that is overlapped at the seam between $a_6$–$f_6$ and $L_2$ is the top overlap of the right hand web portion $e_1$–$f_1$ in final fold configuration and overlapped as at $a_6$–$f_6$.

Either spaced dots, or a continuous line of adhesive will be applied as at position 33, said adhesive bonding the two lapped portions $L_1$ and $L_2$ in the final package. Note that web lines $c_1$ and $d_1$ represent portions of the web that will be coincident with bottom folds on either side of the internal web stack 23, and web lines $b_1$ and $e_1$ will be coincident with fold lines at the top of the package after folding and completion. Overlapped margin $L_1$ is equal to $a_1$–$b_1$, and in the finished package will be coincident with $a_6$–$b_6$. In like manner, margin $L_2$ will be the topmost panel of the completed panel between $e_5$ and $f_6$.

The invention may be practiced in a number of ways and to illustrate this, a further embodiment is described in conjunction with respect to FIGS. 11–16. The superposed web units may be derived from a series of unwind stands and brought into a single lineal path through suitable turning bars as will be brought out hereinafter relative to the embodiment seen in FIG. 11.

Figure 11:
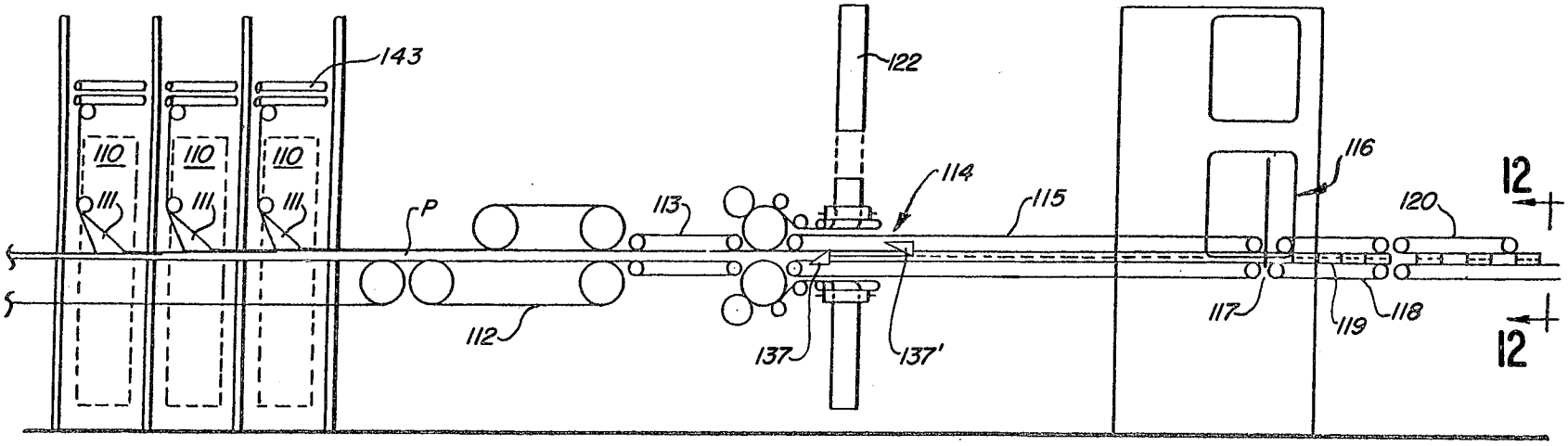
FIG. 11 is a side elevational view of different apparatus advantageously employed in the practice of the inventive method; when using heavy caliper liner board that cannot be formed with the embodiment of FIG. 1 without inducing wrinkles at the fold edges of the pack.

Now with reference to the left hand portion of FIG. 11, there are seen a number of unwind stands 110. For commercial production, the total line would include a suitable quantity of unwinds for handling a number of webs equal to package count, or, as in the instant case, using 2-wide unwinds, the number of stands would equal final package count divided by two and with additional stands added for odd count or over count as derived. Normally, some of the unwinds are in the process of being reloaded and extra stands insure that the ultimate product will contain a minimum of 100 interfolded towels or the like. The paper toweling from the unwind stand can be advantageously interfolded by folding plates 111 which may advantageously take the form of those illustrated in U.S. Pat. No. 4,052,048, although a conventional C-fold (non-interfold) is illustrated. Thereafter the superposed, longitudinally folded webs are advanced along a path P by means of a pull belt section 112 and through a compression belt section 113 into an enveloping station generally designated 114 and which can be seen in greater detail in FIG. 16.

Thereafter, the continuous product now in a continuous enveloped condition is conducted between upper and lower belts constituting compressed conveyor 115 to a cutoff station generally designated 116. There the continuous, enveloped product is transversely severed in the space 117 and removed by a takeaway belt conveyor 118. Thereafter, the discrete packages 119 (see FIG. 12) are spaced apart for packaging by means of a speed-up belt section 120. It will be noted that the belts constituting the compression entry and takeaway conveyors 115 and 118 are separated by the space 117 so as to accommodate the traveling saw 116 in a fashion analogous to the spacing between the bars 35 and 36 (FIG. 2).

Figure 14:
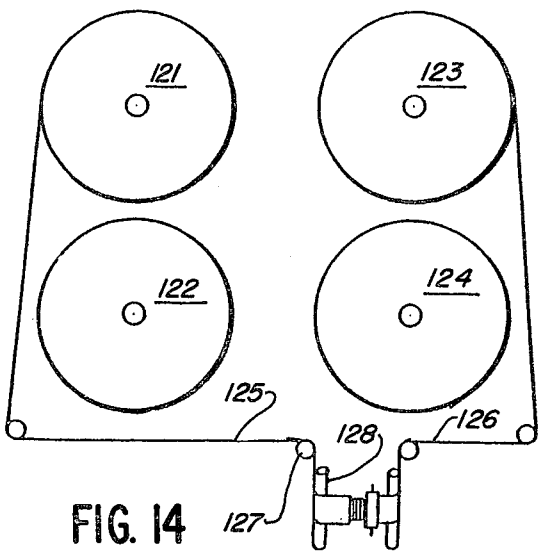
FIG. 14 is an end elevational view of the apparatus of FIG. 13 and as would be seen along the sight line 14—14 applied to FIG. 13.
Figure 13:
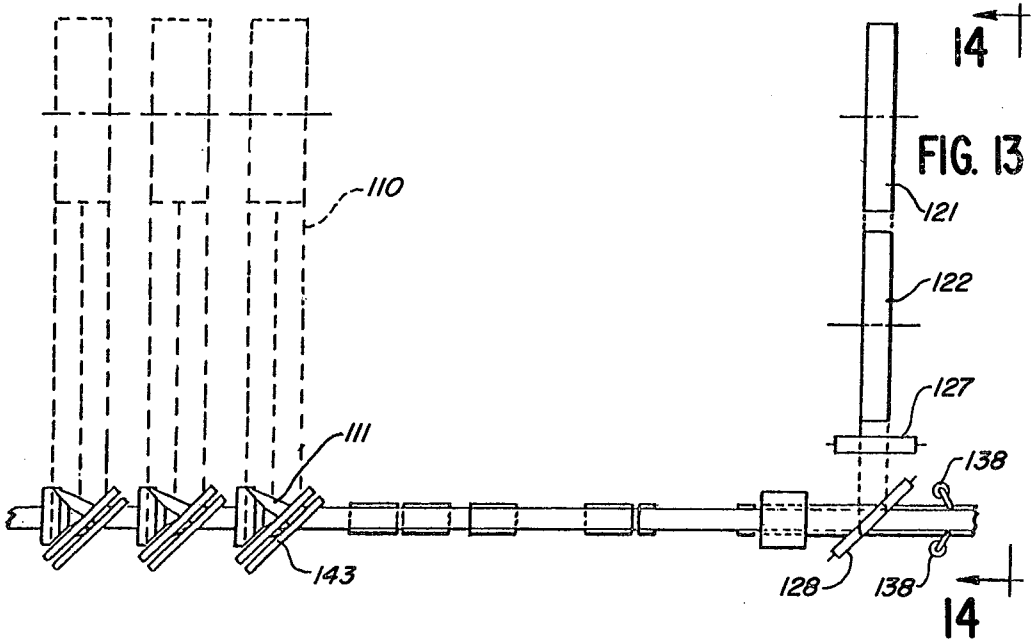
FIG. 13 is a partial top plan view of the apparatus of FIG. 11.
Figure 16:
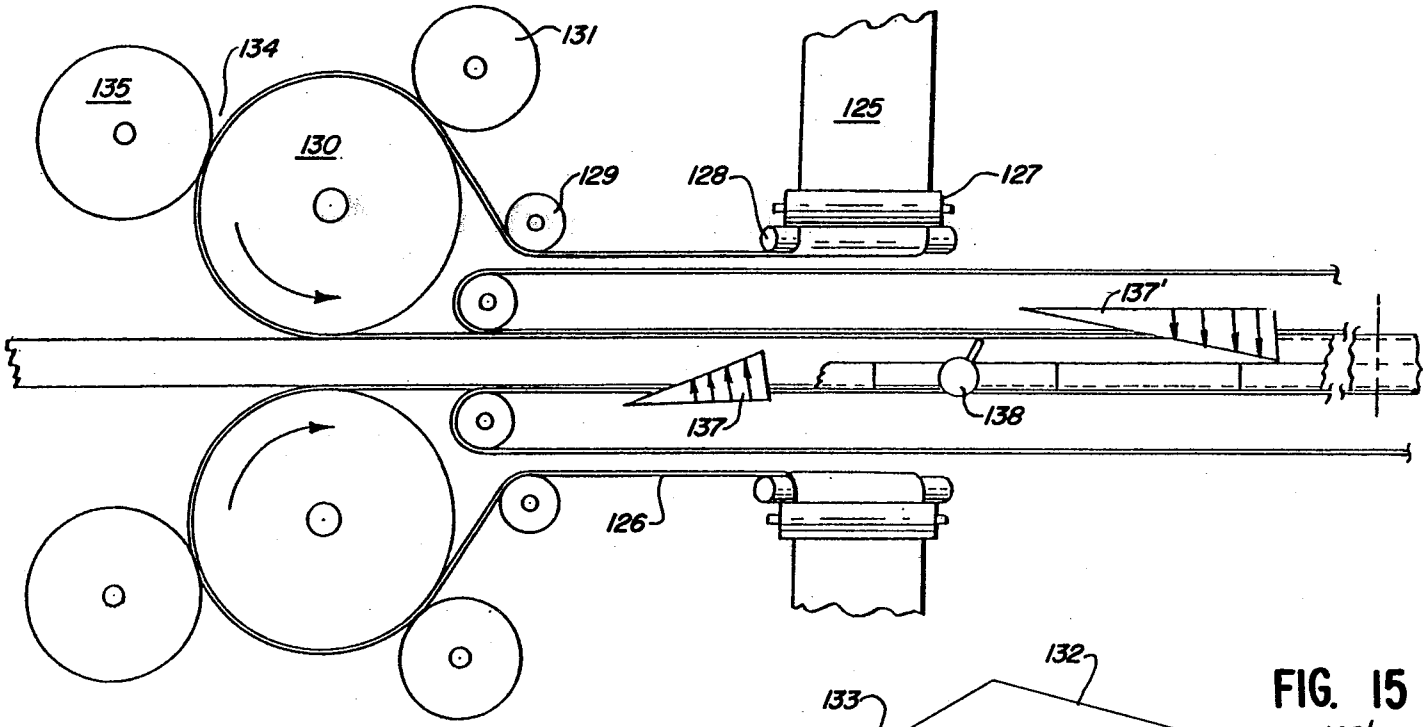
FIG. 16 is an enlarged fragmentary view of the central portion of FIG. 11 and showing the portion of the apparatus employed for forming the cardboard tube about the interfolded facial tissue product.
Figure 15:
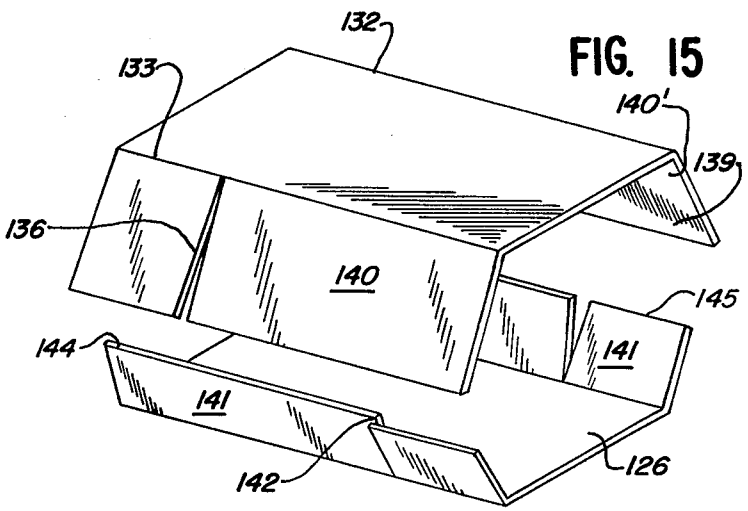
FIG. 15 is a perspective exploded view of the cardboard portions or webs as they are brought together to form the tubular enclosure.
Figure 12:
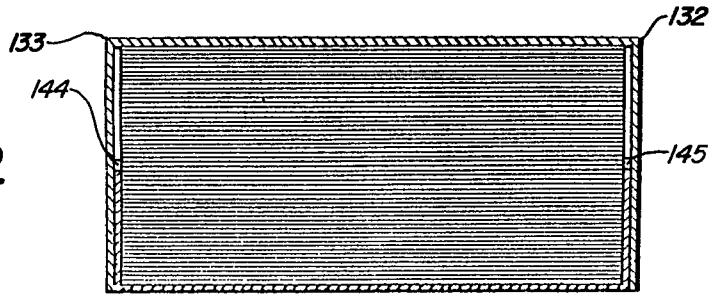
FIG. 12 is an end elevational view of a product produced by the apparatus of FIG. 11 such as would be seen along the sight line 12—12 applied to FIG. 11.

The second embodiment (FIGS. 11–16) is used for heavy caliper wrapping materials that would be prone to severe wrinkling when applied according to the structure of FIGS. 1–10. For the purpose of providing the enveloping of a rectangular cardboard tube around web stack 23, parent rolls 121 and 122 of FIG. 14 are provided for the upper web 125 and parent rolls 123 and 124 for the lower web 126. The upper web 125 travels under a guide roll 127 suitably journalled on the machine frame and over a turning bar 128, being directed backward toward the unwind stand. In the side elevation and exploded view of FIG. 16, it subsequently passes under a guide roll 129 and through the nip between an anvil roll 130 and a scoring roll 131. At this nip between the scoring roll 131 and the anvil roll 310 the top web 125 is scored along the lines 132 and 133 after which, in nip 134 between the anvil roll 130 and the lateral slitting roll 135, slit lines 136 (see FIG. 15) and 136' on the opposite side (not shown) are cut into the web. A similar operation is performed on the web 126 before it encounters the lower folding plow 137.

As the web 125 progresses toward the second folding plow or plate 137' (still referring to FIG. 16) it passes a glue extruder 138 which imprints adhesive dots as at 139 on the underside of the margin 140 of the web 125. As the web 125 passes through the folding plate 137', the margins or flaps 140 are folded downwardly and into contact with the corresponding margins of the web 126. More particularly, the web 126 has narrower margins 141 which are folded upwardly so that the downwardly facing margins 140 of the upper web 125 are brought into contact with the margins 141. Inside contacting face 140' of top web 125 faces downwardly before being folded downwardly. Bottom web edge 144 and 145 are shown as top margins of the inside wrapper—about mid-point in FIG. 12. The margins 141 of the bottom web 126 are also transversely cut at longitudinally spaced points as at 142. Thus, the same general sequence holds for the bottom web except that the side margins are folded upwardly. The side margins, in the illustration given, on the bottom web are only $\frac{7}{8}''$ (approximately 22 mm.) while the top flaps are $1\frac{3}{4}''$ (approximately 44 mm.) and equal to finished package height.

The lateral slits 136 are offset longitudinally from the lateral slits 142 of the bottom web so that there is no possibility that the slits will line up and fail to provide a unitary tube. Further, when the two halves of the band or tube are brought together, there is a tight encircling seal but one wherein the ends are open. The provision of the lateral slits make it possible to gradually fold a consecutive group of side flaps upwardly or downwardly in a relatively heavy cardboard without inducing wrinkles. By relatively heavy cardboard, we refer to the fact that the board has a basis weight of the order of about at least fifty pounds per ream.

In the illustration given, the basis weight of the cardboard was 168 lbs. Exact definition of the character of board useful in the second embodiment of the invention is not precise because many factors enter in—viz., stiffness of the stock (which is related to fiber length, chemical agents, calendaring and other variations). Generally, however, in order to be usable in the invention, the marginal edges should have to have sufficient rigidity that they would respond to the upward or downward urging of the folding plates without collapsing or wrinkling.

While a fifty pound sheet might respond to a system of folding plates without wrinkling, it could also be possible to slit the marginal edges of lighter basis weight stocks without any apparent disadvantage—albeit the fact that slitting is not necessary as long as the material will flow over a folding plate and do so without wrinkling.

As the caliper of the stock increases about 0.005" at the low range, and particularly because these stocks are "nonextensible", the possibility of uneven calipers and variations in the sheet formation of and by themselves introduce the possibility of wrinkling. As heavier basis weights and calipers are used, and regardless of folding board configuration, undesirable wrinkling can occur as they pass over each folding edge—particularly if the stock is laminated.

In each of the embodiments of the invention, there is a definite stack compression achieved after the webs are first completely superposed in the path P. Thereafter the compressed stack of web is permitted to partially regain its original uncompressed height before entering the forming device—thereby achieving a fully packed package but one which is not under such internal stress as to jeopardize the seal. Immediately after the compression phase, a web stack will remain substantially at its compressed height but will slowly recover a certain amount of the height lost through compression. A relatively short space and belt 43 between the web forming device 24 (alternatively 137, 137') and the preceding compression belts 42 (alternatively 113), provide adjustable control of compression recovery.

Following the passage through the former, the enveloped, compressed webs are again subjected to compression belts as at 31, 32 relative to the showing in FIGS. 1 and 2 or the belt system 115 of FIG. 11 to isolate adhesive bonds from strain during setup. The intermediate compression rollers 56 of the compression conveyor belts 31 and 32 are equally advantageously employed with the compression belt system 115 but have been omitted for the sake of clarity. Normally we prefer the compression length following formation to be at least twice that of the compression length performed prior to envelopment.

While in the foregoing specification, a detailed description of the invention has been set down for the purpose of illustration, many variations in the details hereingiven may be made by those skilled in the art without departing from the spirit and scope of the invention.

We claim:

1. A method of manufacturing a packaged web product such as facial tissue, toweling and the like comprising:

advancing at uniform speed a plurality of superposed webs of indefinite length along a lineal path, compressing said superposed webs in a direction to the superposition thereof and to an extent of reducing the superposed height to below about 75% of the uncompressed height, passing said compressed webs through an open-ended forming device and simultaneously enveloping said superposed compressed webs within said forming device in an indefinite length with over lap folded wrapping material, sealing said over lap folded web means in the over lapped portion while maintaining said superposed webs under compression, and transversely severing the enveloped, compressed web at equally longitudinally spaced apart transverse lines in said path and while said webs are being advanced.

2. The method of claim 1 in which said forming device has a closed perimeter shaped to the dimensions of said compressed superposed webs and said over lap folded wrapping material includes a single web.

3. The method of claim 1 in which said forming device includes a pair of folding plows spaced apart longitudinally in said path for sequentially shaping a pair of enveloping webs about opposite side portions of said compressed webs.

4. The method of claim 3 in which each of said enveloping webs is constructed of cardboard with each cardboard web being equipped with a transverse cut extending inwardly from each longitudinal edge thereof a predetermined distance to terminate in a pair of longitudinal margin lines for each cardboard web, advancing said cardboard webs along spaced apart paths parallel to said lineal path and longitudinally folding one cardboard web along its margin lines to dispose the margins thereof toward the other cardboard web, thereafter folding said other cardboard web along its margin lines to dispose the margins thereof in contacting relation with the margins of said one cardboard web while adhering said contacted margins together to form a continuous tube.

5. The method of claim 4 in which the transverse cuts in said one cardboard web are longitudinally offset from the cuts in said other cardboard web.

6. The method of claim 4 in which said one cardboard web is narrower than said other cardboard web but wherein the distance between margin lines is about the same in both cardboard webs.

7. The method of claim 4 in which adhesive is applied to the margins of said other cardboard web prior to folding thereof.

8. The method of claim 1 in which said superposed webs are paper towels.

9. The method of claim 1 in which said enveloped, compressed webs are clamped by longitudinally spaced apart means in said path during said transverse severing.

10. The method of claim 9 in which said enveloped, compressed webs are subjected to compression between said enveloping and said clamping.

11. The method of claim 9 in which said spaced apart means includes belt conveyors spaced apart longitudinally in said path.

12. The method of claim 1 in which said compressed, superposed webs are expanded prior to enveloping to increase the height thereof but while still maintaining some compression thereon.

13. The method of claim 12 in which the initial compressing is performed by a plurality of pairs of rolls on opposite sides of said path, said pairs being spaced relatively close together longitudinally of said path, said roll plurality terminating a spaced distance upstream of said forming device to permit partial regain of said uncompressed superposed height.

14. A method of manufacturing a packaged web product such as facial tissue, toweling and the like comprising: advancing at uniform speed a plurality of superposed webs of indefinite length along a lineal path, compressing said superposed webs in a direction to the superposition thereof and to an extent of reducing the superposed height to below about 75% of the uncompressed height, partially relaxing the compression of said superposed webs and passing said compressed webs through an open-ended forming device having a closed perimeter shaped to the dimensions of said compressed superposed webs and simultaneously enveloping said superposed compressed webs within said forming device in an indefinite length with over lap folded wrapping material, sealing said wrapping material in the over lapped portion while maintaining said superposed webs under compression, and transversely severing the enveloped, compressed webs at equally longitudinally spaced apart transverse lines in said path and while said webs are being advanced.

15. A method of forming a rectangular cardboard tube about stacked superposed paper webs comprising providing a pair of elongated cardboard webs, transversely cutting each cardboard web inwardly from each longitudinal edge thereof a predetermined distance to terminate in a pair of longitudinal margin lines for each cardboard web, advancing said cardboard webs along spaced apart parallel paths and about said stacked superposed paper webs and longitudinally folding one cardboard web along its margin lines to dispose the margins thereof toward the other cardboard web, thereafter folding said other cardboard web along its margin lines to dispose the margins thereof in contacting relation with the margins of said one cardboard web while adhering said contacted margins together to form a continuous tube about said stacked superposed paper webs, and transversely severing said tube along longitudinally spaced apart lines.

16. A method of enveloping a continuous product comprising advancing said product along a predetermined path, advancing a first elongated cardboard web along a path below said predetermined path and advancing a second elongated cardboard web along a path above said predetermined path, said cardboard webs being equipped with longitudinally extending score lines spaced apart approximately the width of said continuous product to define side margins, said margins being cut at longitudinally spaced points with the cuts in the margins of said lower cardboard web being non-aligned with the cuts in the margins of said upper cardboard web, folding the margins of said lower cardboard web upwardly to partially embrace said continuous product, applying adhesive to the undersides of the margins of said upper cardboard web and thereafter folding said upper cardboard web margins downwardly into contacting adhering relation with the margins of said lower cardboard web, and transversely severing the enveloped product at longitudinally spaced lines.

17. Apparatus for manufacturing a packaged web product comprising a frame with means defining a lineal path for advancing a plurality of superposed webs of indefinite length, means operably associated with said frame for superposing a plurality of webs and introducing the same into said path, means on said frame on opposite sides of said path for compressing said superposed webs in a direction to the superposition thereof and to an extent of reducing the superposed height to below about 75% of the uncompressed height, an open ended forming device on said frame in said path, means operably associated with said frame for delivering an indefinite length wrapping material to said forming device to sealingly envelope said superposed compressed webs within said forming device, and means on said frame for transversely severing the enveloped, compressed web at equally longitudinally spaced apart transverse lines in said path and while said webs are being advanced.

18. The apparatus of claim 17 in which said forming device has a closed perimeter shaped to the dimensions of said compressed superposed webs and said wrapping material includes a single web.

19. The apparatus of claim 18 in which said forming device has a box shape with one side thereof defined by overlapping wings spaced apart approximately the thickness of said single web.

20. The apparatus of claim 17 in which said forming device includes a pair of folding plows spaced apart longitudinally in said path for sequentially shaping a pair of enveloping webs about opposite side portions of said compressed webs.

21. The apparatus of claim 17 in which longitudinally spaced apart means are provided on said frame for clamping said enveloped, compressed webs in said path during said transverse severing.

22. The apparatus of claim 21 in which said spaced apart means are clamping bars carried by chains.

23. The apparatus of claim 17 in which means are provided on said frame for relaxing the degree of compression on said superposed webs just prior to enveloping thereof.

24. The apparatus of claim 23 in which said frame is equipped with a plurality of pairs of rolls on opposite sides of said path, for compressing said superposed webs, said pairs being spaced relatively close together longitudinally of said path, said roll plurality terminating a spaced distance upstream of said forming device to permit partial region of said uncompressed superposed height.

25. The apparatus of claim 24 in which an endless belt is entrained over said rolls, one on each side of said path, each said belt also being entrained on head and tail rolls journaled in said frame, said head rolls being spaced apart a distance greater than the spacing of the rolls in each pair.

26. The apparatus of claim 24 in which said frame is equipped with a second plurality of pairs of rolls on opposite sides of said path for compressing said enveloped, compressed webs.

27. The apparatus of claim 26 in which said second plurality extends along said path at least about twice the distance of the first-mentioned plurality.

* * * * *